United States Patent [19]

Watanabe

[11] Patent Number: 4,839,927

[45] Date of Patent: Jun. 20, 1989

[54] DRAINAGE SYSTEM IN MULTI-STORY BUILDING

[75] Inventor: Takashi Watanabe, Tokyo, Japan

[73] Assignee: Nishihara Engineering Company, Ltd., Tokyo, Japan

[21] Appl. No.: 82,317

[22] Filed: Aug. 6, 1987

[30] Foreign Application Priority Data

Nov. 14, 1986 [JP] Japan ..... 61-269946
Nov. 21, 1986 [JP] Japan ..... 61-276820

[51] Int. Cl.[4] ..... E03D 9/04
[52] U.S. Cl. ..... 4/211; 4/191
[58] Field of Search ..... 4/661, 211, 219, 209 R, 4/191, 340, 342, DIG. 7

[56] References Cited

U.S. PATENT DOCUMENTS 2,067,078 6/1937 Faber ..... 4/211
4,073,018 2/1978 Arrowood ..... 4/211

*Primary Examiner*—A. D. Pellinen
*Assistant Examiner*—Morris Ginsburg
*Attorney, Agent, or Firm*—Sherman and Shalloway

[57] ABSTRACT

A drainage system installed in a building for conducting waste water from such sanitary fixtures as toilet bowls into the underground sewer, has a stack extending through the floor of each story of the building and branch pipes for conducting the waste water from the fixtures mounted on each floor into the stack through connectors. The stack and each connector have a double structure comprising inner and outer members. The inside of the inner member is used for the discharge of waste water, while the space formed between the inner and the outer member communicates with the inside of the inner member within each connector to permit the flow of air necessary for eliminating a pressure variation induced inside the inner members by the flow of waste water.

16 Claims, 12 Drawing Sheets

DRAINAGE SYSTEM IN MULTI-STORY BUILDING

BACKGROUND OF THE INVENTION

1. Field

The present invention relates to a drainage system for transferring waste water gathered from fixtures of various types disposed at different heights or levels, mainly in a vertical direction to a drain pipe disposed in a lower position. The drainage system according to the present invention is particularly suitable for installation in a high-rise building.

2. Prior Art

A drainage system for conducting waste water from such fixtures as toilets and bathrooms installed in a multi-story building to the underground sewer main or any other drainage equipment is generally provided with an approximately vertically extending main pipe or stack which is connected at the lower end to the public sewerage, and also provided with generally horizontally extending branch pipes for conducting waste water from fixtures on each floor to the stack. The upper end of the stack is open to the atmosphere. When waste water from a certain branch pipe flows down through the stack, the pressure in the stack is low in an upper position of the waste water and high in a lower position. The inflow timing and amount of waste water from each branch pipe into the stack are usually very irregular, so the pressure developed irregularly in the stack may impede a smooth flow of waste water. In some cases, a positive or negative pressure is so large as to destroy the waste trap attached to the equipment. The longer the stack in the vertical direction, the more remarkable this tendency, so in the drainage system for a high-rise building employing a very long stack there usually is provided a vent means for preventing variation in the intra-stack pressure separately from the drain pipe.

FIG. 1 shows a known drainage system having such vent means. A stack 1 extending vertically through the floor of each story is connected at the lower end thereof to a horizontal pipe 2 which is connected to a public sewerage 10, and the stack, at the upper end thereof, is connected to a vent pipe 3. The other end of the vent pipe 3 is open to the atmosphere. Numeral 4 denotes a drain branch disposed along each floor. Each branch is connected to the stack 1 through a connector 5 to conduct waste water from a fixture 6 such as a toilet bowl to the stack 1. Numeral 7 denotes a main vent disposed near the stack 1 approximately in parallel therewith. The main vent 7 is connected at both ends thereof to both ends of the stack 1 and further connected to the stack 1 in arbitrary longitudinal positions through connecting vent pipes 8. Further, branch vents 9 are provided if necessary. The branch vents 9 are connected to the main vent 7 in arbitrary positions through the drain branches 4.

Waste water from any of the fixtures 6 flows into the stack 1 through the drain branch 4 to which the fixture is connected and further through the connector 5, then flows down through the stack and enters the sewer pipe through the horizontal pipe 2. During this period, a pressure variation which occurs in the stack 1 or which in some case may occur also within the horizontal pipe 2, is absorbed by the air introduced from or discharged to the main vent 7, whereby smooth drainage is ensured.

The greatest problem of such known drainage system resides in the complexity of the piping structure including the main vent 7 which must be provided separately from the stack 1 and the connecting vent pipes 8 which connect the main vent 7 to the stack 1. Such a complicated piping structure is disadvantageous in point of the working cost and the construction period required. And an accident such as water leakage is very likely to occur. Another drawback of the known drainage system which should not be disregarded is that there occurs turbulence of flow at the portions where waste water changes its flowing direction largely, that is at the connections between the drain branches 4 and the stack 1 and at the connection between the stack 1 and the horizontal pipe 2, the said turbulence not only enlarging the pressure variation but also causing noise, with the result that the performance limit of the entire system remains low.

SUMMARY OF THE INVENTION

It is an object of the present invention to provide a drainage system in a multi-story building, having a simplified piping structure.

The simplification of the piping structure which the present invention contemplates is attained by using a stack and connectors both having a double structure. More specifically, there are used plural stack segments and plural connectors each disposed between adjacent stack segments, the stack segments and the connectors having a cylindrical outer member and a cylindrical inner member inserted in the outer member, presenting an appearance of a single pipe structure. The inside of the inner member serves as a passage for waste water and the space between the inner and the outer member serves as a passage for air. The thus-formed drainage passage and vent passage are interconnected within the connectors to ensure the flow of air sufficient to eliminate a pressure variation caused by an irregular flow of waste water.

According to a preferred embodiment of the present invention, there is provided a drainage system including a stack which comprises a plurality of segments aligned approximately vertically through the floor of each story of a multi-story building; a plurality of connectors each disposed between adjacent such segments; a plurality of branch pipes each connected to one or more fixtures which discharge waste water, said branch pipes being further connected at one end thereof to the stack through the connectors to conduct the waste water from the fixtures to the interior of the stack; and a lower end connector for connecting the lower end of the stack to a horizontal pipe, characterized in that the said stack segments are each provided with a cylindrical outer member and a cylindrical inner member which is inserted into the outer member coaxially to form an axially extending space annular in cross section between the outer peripheral surface thereof and the inner peripheral surface of the outer member, the inside space of the inner member serving as a passage for waste water or a drainage passage and the space annular in cross section formed between the inner and the outer member serving as a passage for air or a vent passage, and that the said connectors are each provided with a generally cylindrical outer member connected to the stack segments positioned just above and below and also provided with a generally cylindrical inner member inserted into the outer member coaxially, with a space annular in cross section being formed between the connector outer member and the connector inner member, which space serves as a vent passage for communication between the vent passage of the upper stack segment and that of the lower stack segment, the space formed inside the connector inner member serving as a drainage passage for communication between the drainage passage of the upper stack segment and that of the lower stack segment, the connectors being each further provided with an inlet pipe which is disposed so as to extend through the connector outer member in a direction approximately coincident with a tangent to a circle formed by the inner peripheral surface of the connector inner member and which is connected at one end thereof to the corresponding branch pipe and is open at the opposite end thereof to the inner peripheral surface of the inner member.

The drainage system of the present invention is also characterized in that, as set forth above, the connectors are each provided with an inlet pipe extending in a direction approximately coincident with a tangent to the inner peripheral surface of its inner member. Under this characteristic construction, the waste water flowing into the inner member from the inlet pipe then flows down while circling along the inner peripheral surface of the inner member, whereby smooth and quiet confluence is realized.

According to another embodiment of the present invention, the circling flow created by the inflow of waste water from the tangential direction is also applied to the lower end connector which connects the lower end of the stack with the horizontal pipe which is disposed approximately horizontally.

PREFERRED EMBODIMENTS

Figure 1:
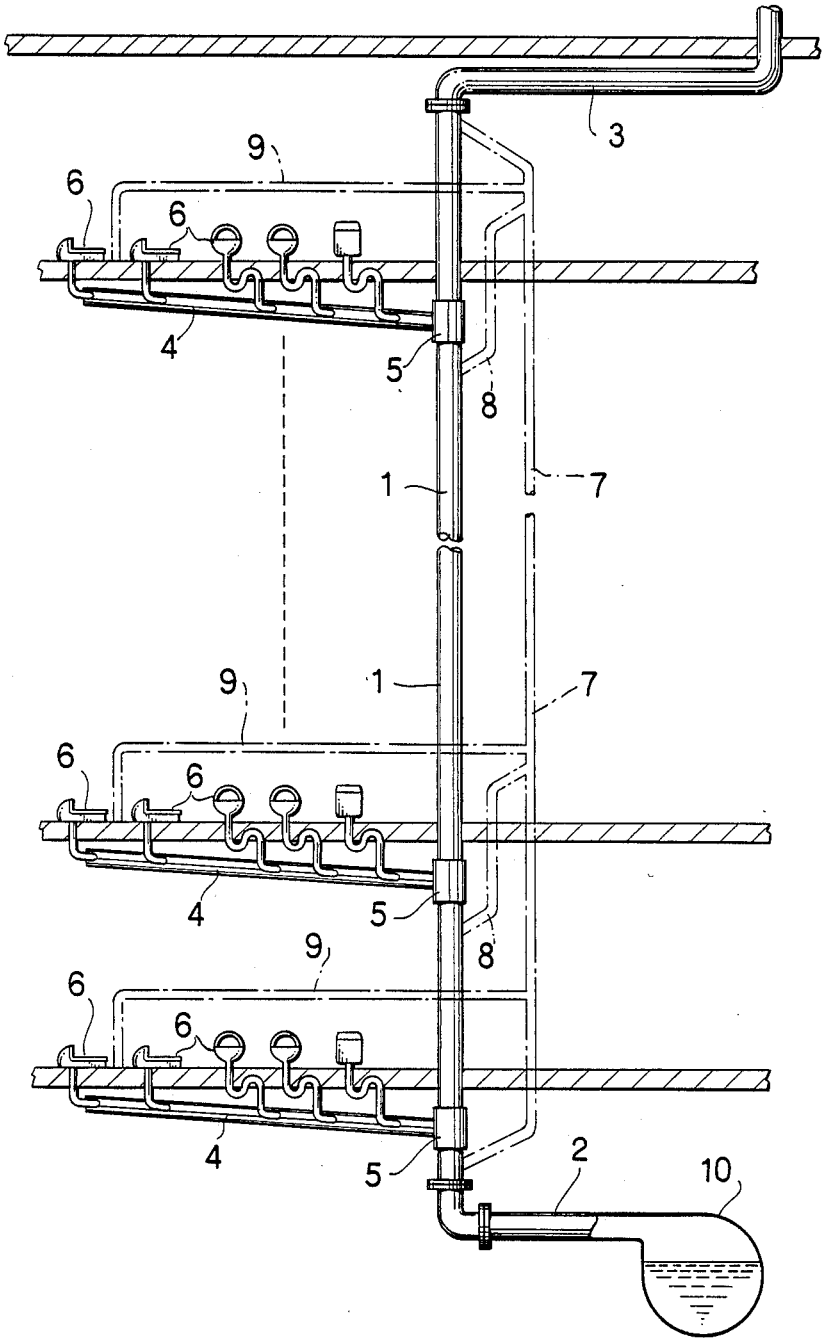
FIG. 1 (PRIOR ART)
FIG. 1 is an elevation schematically showing a conventional stack drainage system.
Figure 2:
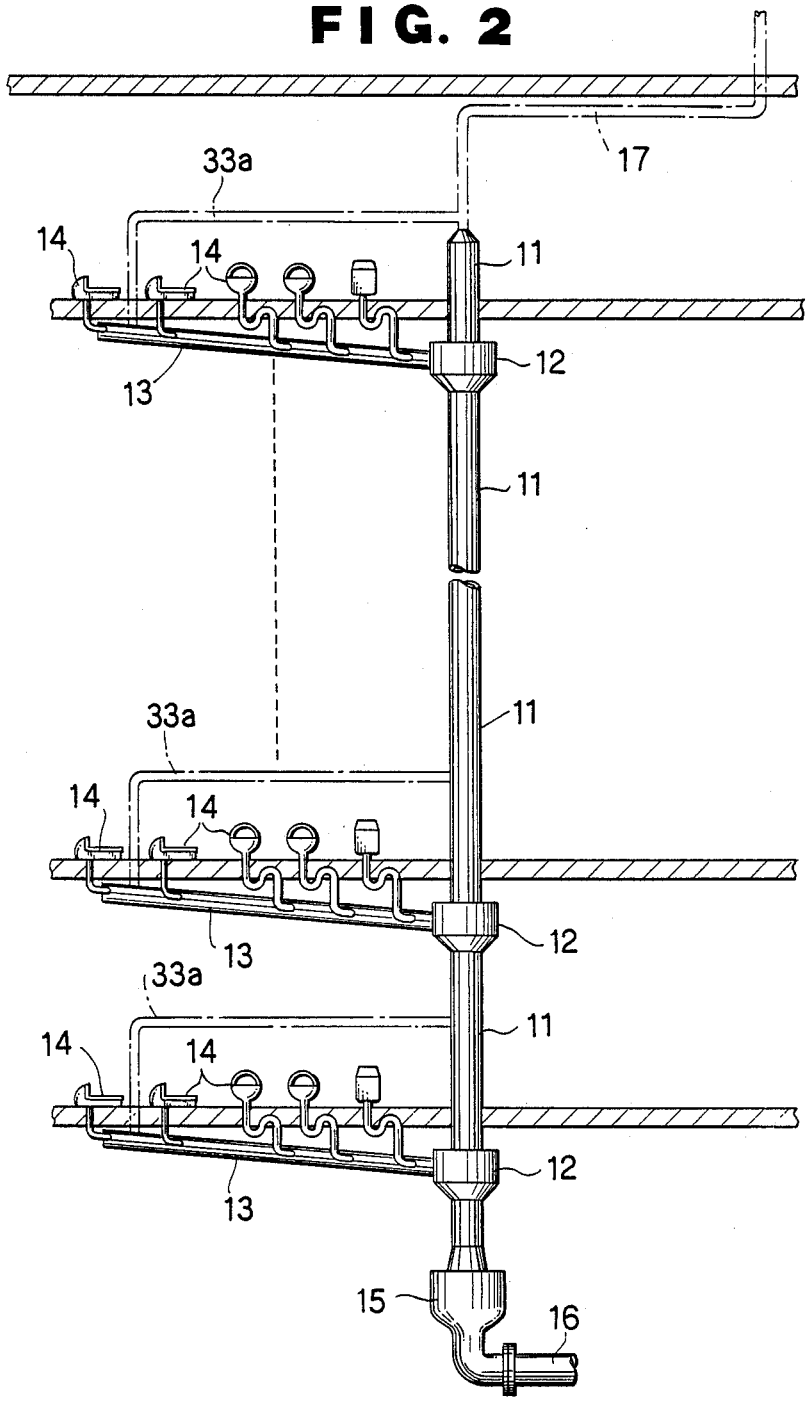
FIG. 2 is an elevation schematically showing a drainage system according to the present invention.

In FIG. 2 which illustrates a preferred embodiment of the present invention schematically, a stack 11 is disposed so as to extend nearly vertically through the floor of each story, and a connector 12 which will be described in detail later is attached to the stack 11 at every story. Each connector 12 is for introducing waste water from fixtures 14 on each story into the stack 11 through a drainage branch 13. The lower end of the stack 11 is connected to the public sewerage through a lower end connector 15 further through a horizontal pipe 16. On the other hand, the upper end of the stack 11 is open to the atmosphere through a pipe 17.

Figure 3:
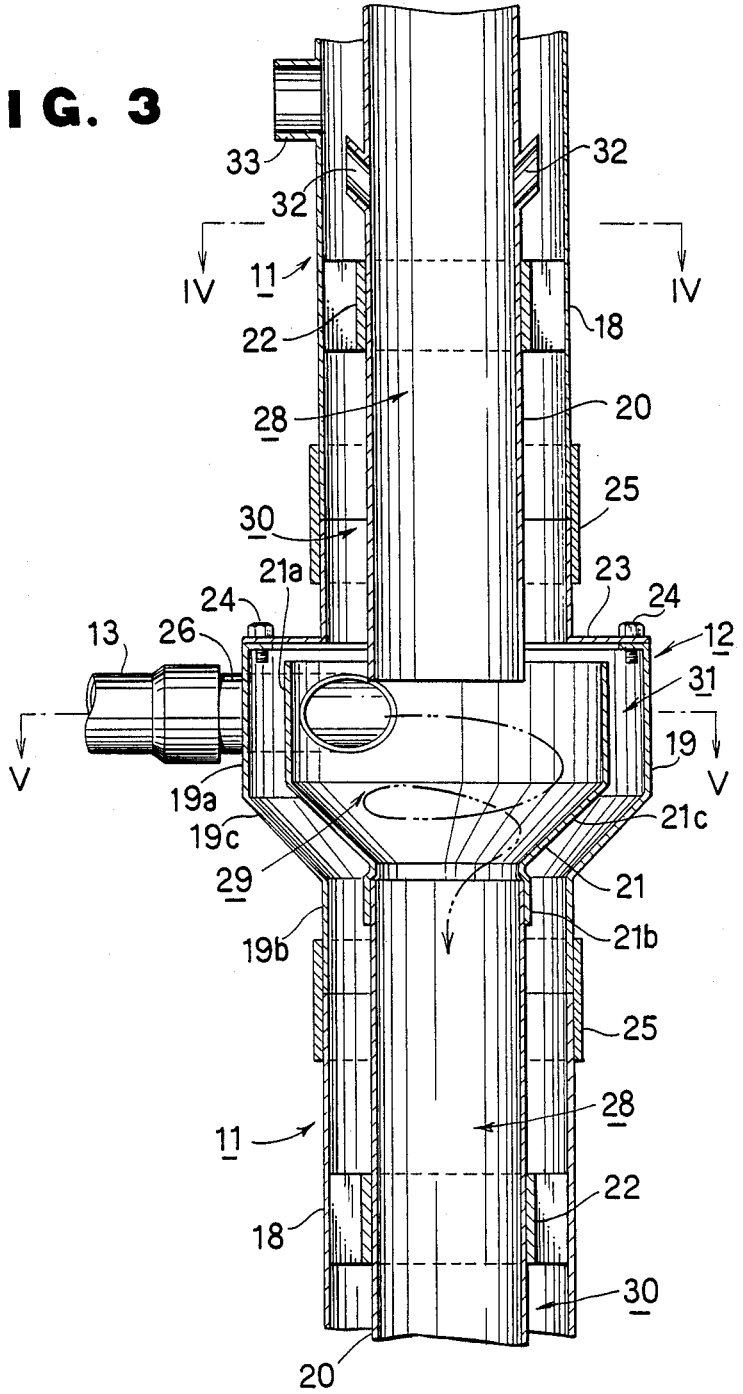
FIG. 3 is a partially enlarged sectional view of the drainage system shown in FIG. 2.

The stack 11 and the connectors 12 are characterized by having a double structure. In FIG. 3 there are shown one connector 12 and a portion of two segments of the stack 11 interconnected through the connector 12. Each segment is provided with a cylindrical outer member 18 and a cylindrical inner member 20. The inner member 20, which has an outside diameter smaller than the inside diameter of the outer member 18, is disposed coaxially through the central bore of the outer member 18 to form a space annular in cross section between it and the outer member. The central bore of the inner member 20 is used as a passage 28 for waste water, while the space between the outer member 18 and the inner member 20 is used as a passage 30 for gas. Preferably, the passage 30 is in communication with the passage 28 through communication paths 32 which extend obliquely upward through the peripheral wall of the inner member 20. If necessary, a connecting pipe 33 is attached to the outer member 18. The connecting pipe 33 provides a connection port in the case where the drainage branch 13 connected to the connector 12 is so long that it is necessary to provide a vent branch **33*a* (shown in FIG. 2) for connection between the drainage branch 13 and the annular passage 30**.

Figure 4:
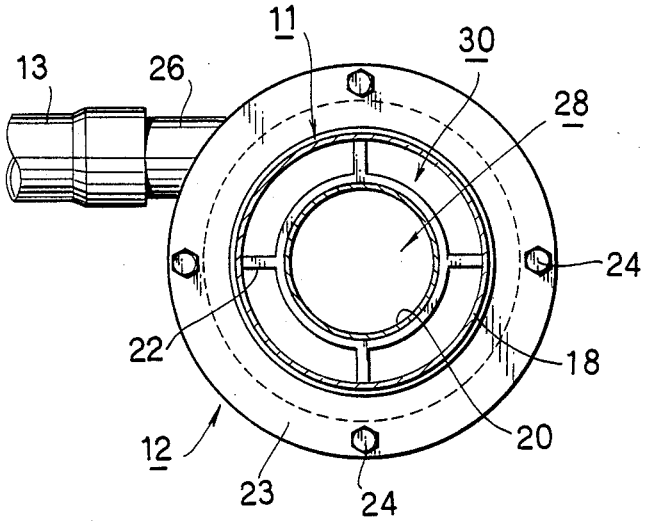
FIG. 4 is a sectional view taken along line IV—IV of FIG. 3.

There may be provided spacers 22 in appropriate longitudinal positions so that the inner member 20 can be held positively in predetermined positions within the central bore of the outer member 18. As best seen in FIG. 4, the spacers 22 each comprise a sleeve through which the inner member 20 extends and four plate members extending radially from the outer peripheral surface of the sleeve and reaching the inner peripheral surface of the outer member 18.

The connector 12 has an outer member 19 which comprises a first cylinder **19*a* having a diameter larger than that of the outer member 18, a second cylinder 19*b* having a diameter equal to that of the outer member 18 and disposed below the first cylinder coaxially therewith, and a tapered portion 19*c*. The outer member 19 is connected to the lower end of the outer member 18 of the stack segment positioned above airtightly through a connecting member 23 with flange bolted at 24 and further through a connecting sleeve 25. Also, it is connected at the lower end of the second cylinder 19*b* to the upper end of the outer member 18 of the stack segment positioned below through a connecting sleeve 25**.

Inside the outer member 19 of the connector 12 is coaxially disposed an inner member 21 which is similar in shape to the outer member. The inner member 21 also comprises a first cylinder **21*a*, a second cylinder 21*b* and a tapered portion 21***c* as a connection of both cylinders, and it is firmly connected at the lower end of the second cylinder 21*b* to the upper end of the inner member 20 of the stack segment positioned below. But the upper end of the first cylinder 21*a* is not in contact with any other member. The size of the inner member 21 is set much smaller than that of the outer member 19 to form an appropriate passage 31 between both members, whereby the passage 30 of the upper stack segment is communicated with that of the lower stack segment through the passage 31. Likewise, a passage 29 formed inside the inner member 21 provides communication of the passage 28 of the upper stack segment with that of the lower stack segment.

Figure 5:
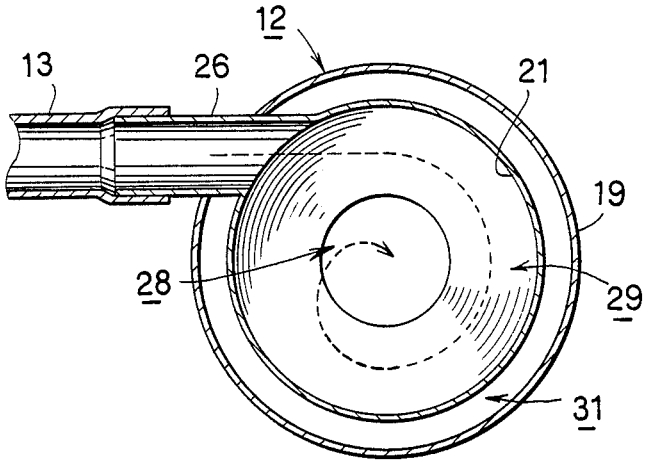
FIG. 5 is a sectional view taken along line V—V of FIG. 3.
Figure 6:
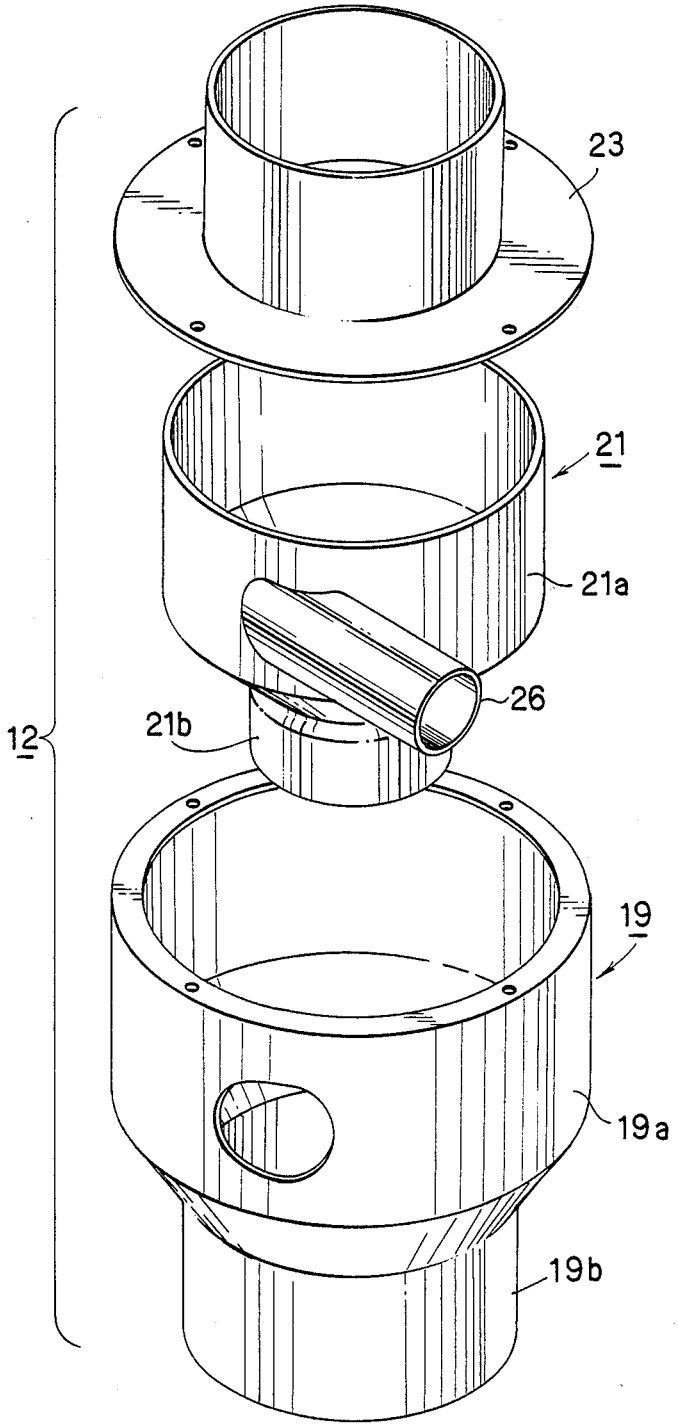
FIG. 6 is an exploded perspective view of a connector shown in FIGS. 2 to 5.

As best seen in FIGS. 4, 5 and 6, the connector 12 is provided with an inlet pipe 26 to which is connected the corresponding branch 13. The pipe 26 is disposed so as to extend approximately in the direction of a tangent to the inner peripheral surface of the first cylinder 21*a* of the inner member 21. It extends through the circumferential wall of the outer member 19 and is open at the fore end thereof to the inside passage 29 of the inner member 21.

When waste water from any of the fixtures 14 flows into the inner member 21 at a certain flow velocity through the branch 13 and the inlet pipe 26 connected thereto, the flow of the waste water goes down while circling along the inner peripheral surface of the inner member 21 as indicated with broken line in FIG. 5 because the flowing direction of the waste water is approximately tangent to the inner peripheral surface of the inner member 21. Such a circling flow permits an extremely smooth change of the flowing direction in comparison with the case where the inflow of waste water collides with a wall which is near perpendicular to the flowing direction of the waste water.

Turning again to FIG. 3, the waste water which has entered the passage 29 through the branch 13 and the inlet pipe 26 flows down while circling further through the passage 28. A pressure variation induced in the passage 28 of the stack 11 by such descending flow of waste water is absorbed by a free flow of air flowing into the passage 28 from the air passage 30 which is open to the atmosphere at the upper end and which is annular in cross section, and that flowing in the opposite direction through the passage between the inner member 20 and the connector outer member 19.

As the components of the stack 11 and the connector 12 there may be used materials which are employed at the corresponding portions of a conventional drainage system. Preferably, the outer members 18 and 19 are formed of asbestos cement or thin-walled steel which has been subjected to a rust preventing treatment, while the inner members 20 and 21 are formed of such a plastic material as polyvinyl chloride.

Figure 7:
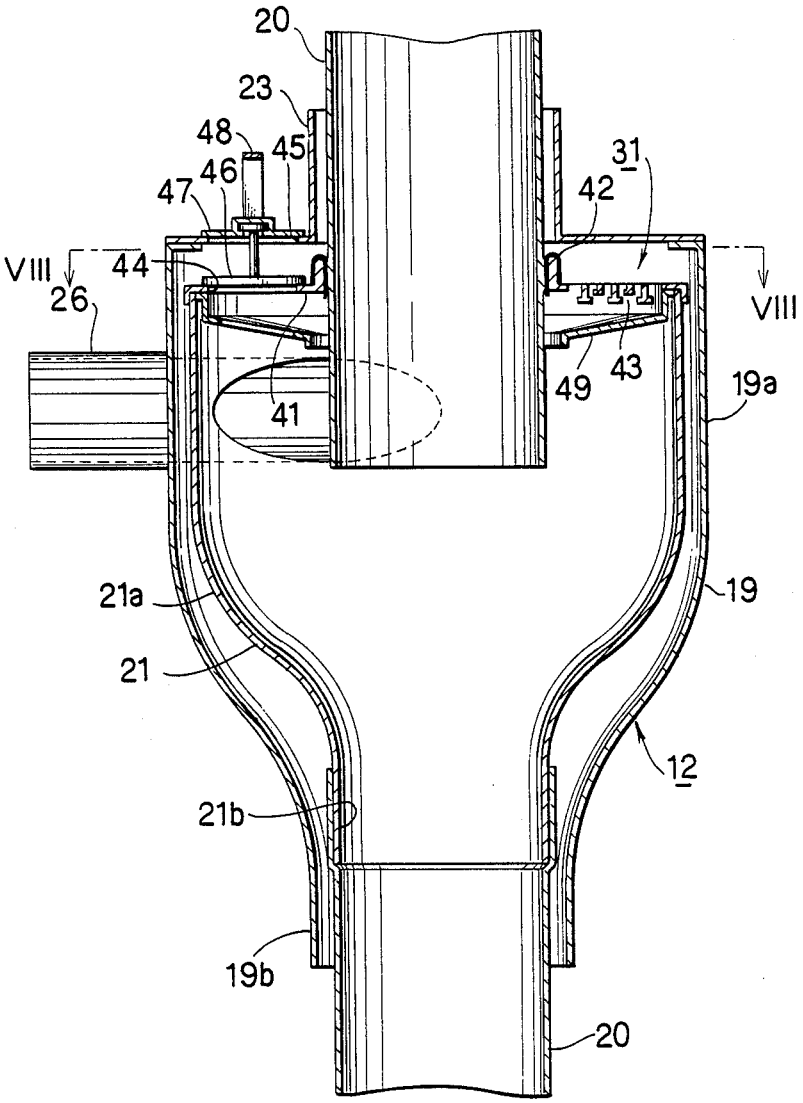
FIG. 7 is a transverse sectional view of a connector used in another drainage system according to the present invention.
Figure 8:
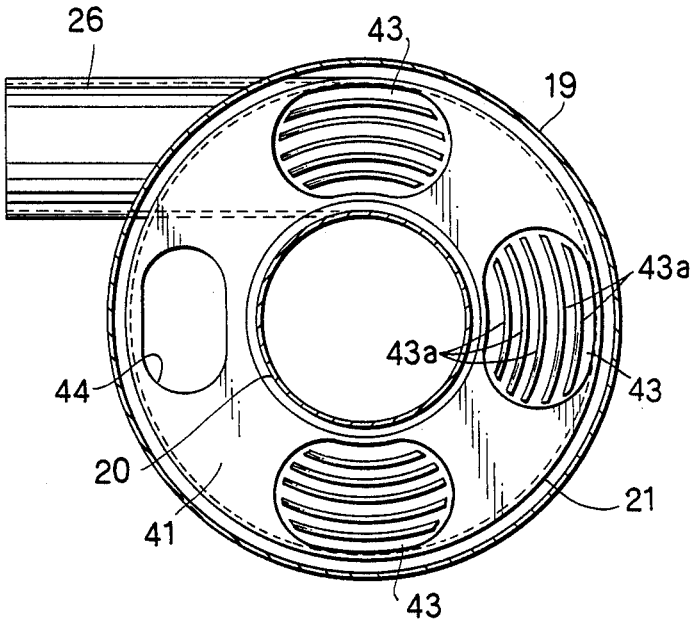
FIG. 8 is a sectional view taken along line VIII—VIII of FIG. 7.

Referring now to FIGS. 7 and 8, there is shown a modified example of a connector employable in the invention. In this modified example, a light change is made in the shape of the outer member and that of the inner member as compared with the connector shown in FIGS. 2 to 6, but both connectors are substantially the same in point of function, so the corresponding portions are indicated by the same reference numerals. The connector shown in FIGS. 7 and 8 is different from the previous connector in that an end plate or a cap ring, indicated by the reference numeral 41, is attached to the upper end of an inner member 21. The cap ring 41 is fitted at its outer peripheral edge on the upper end of the inner member 21. It has a central hole for extending therethrough of the lower end portion of the inner member 20 of the stack segment positioned above. Preferably, a ring-like packing 42 is provided between the cap ring 41 and the said inner member. This packing is in contact with the outer peripheral surface of the inner member 20 under exertion of a slight friction which permits relative displacements of the inner member 20 caused by axial expansion and contraction with changes in temperature. In the presence of the packing 42, the occurrence of a vibrational collision sound between the inner member 20 and the connector 12 and that of creaks caused by expansion and contraction of the inner member are prevented effectively.

As best seen in FIG. 8, the cap ring 41 is provided with vent members 43 which are spaced appropriately from one another. The vent members 43 are each in the form of a generally elliptical plate having plural slits 43*a*. They are tightly fitted in holes of the corresponding shape formed in the cap ring 41. In the specific example illustrated, the slits 43*a* formed in the vent members 43 extend along five concentric circles having a common axis in the position of the axis of the cap ring 41. Under each slit is formed a bent passage by the combination of two kinds of alternately disposed members, one being inverted T-shaped and the other L-shaped in cross section, as shown in FIG. 7. The plural bent passages including the slits 43*a* of the vent members 43 prevent the passing of liquid between the vent passage 30, which is formed between the outer member 18 and the inner member 20 of the stack 11, and the interior of the connector inner member 21, but permits the passing of air at a sufficient flow rate.

Figure 9:
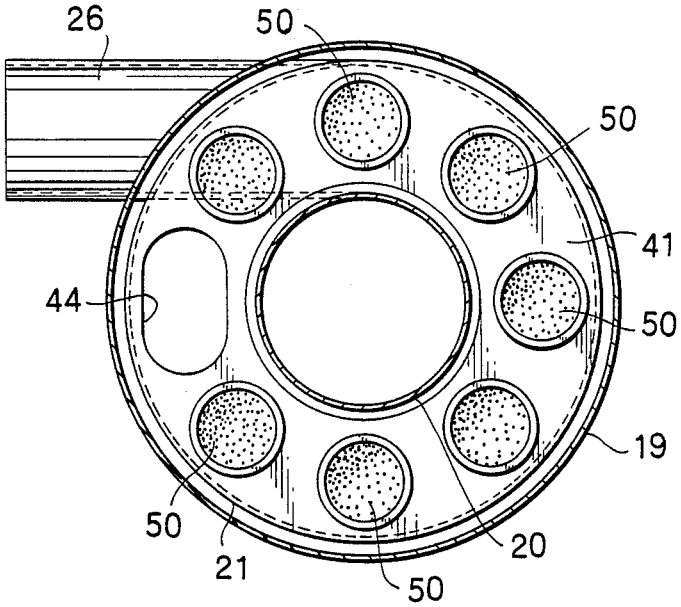
FIG. 9 is a sectional view similar to FIG. 8, showing another example of a connector.
Figure 10:
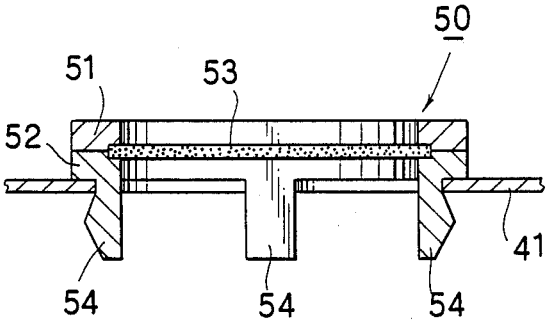
FIG. 10 is a transverse sectional view of a vent member used in FIG. 9.

Referring now to FIG. 9, there is illustrated a connector 12 having a cap ring 41 provided with another form of vent members 50. The vent members 50, as shown in FIG. 10, are each provided with two rings 51 and 52 which are about the same in outside and inside diameters, and a filter element 53 held therebetween. The lower ring 52 has four fasteners 54 extending downward from the lower surface of the ring. The fasteners 54 pass through holes formed in the cap ring 41 and engage the lower surface of the ring, whereby the vent members 50 are fixed to the cap ring in predetermined positions.

The filter element 53, which is preferably a polyurethane or sponge sheet, permits the flow of air therethrough into or from the inside of the inner member 21 of the connector 12, but prevents liquid from flowing out therethrough together with the current of air flowing out of the inside of the inner member 21. Another filter element suitable for this purpose is in the form of a sheet comprising entangled synthetic fibers such as polyvinylidene chloride, polyester or polyamide fibers. Various conventional nets known as filter elements are also employable advantageously.

Below the cap ring 41 there is provided a baffle 49 if necessary. The baffle 49 is in the form of a ring having an outside diameter almost equal to the inside diameter of the inner member 21 and also having an inside diameter slightly larger than the outside diameter of the inner member 20 of the stack. It is fixed through a slightly rising peripheral edge thereof to the lower surface of the cap ring 41 by a suitable fixing means, with the inner member 20 passing through the central hole of the baffle 49. That is, the principal portion of the baffle 49 is positioned below the vent members 43 and an annular passage is formed between it and the inner member 20.

The baffle 49 prevents a gathering of bubbles formed by a complicated flow of liquid inside the inner member 21 of the connector 12, from contacting the vent members 43 after ascending inside the inner member 21 and impairing the permeability thereof.

The cap ring 41 is further provided with an opening 44 for inspecting the interior of the passage 29. The opening 44 cooperates with an opening 45 formed in the connecting member 23 in the position opposed thereto to thereby permit inspection of the interior of the passage 29 from the exterior of the connector. The openings 44 and 45 are closed with interconnected closure members 46 and 47, respectively, except when it is necessary to open them for inspection. Numeral 48 denotes a handle attached to the closure member 46. The closure member 47 which closes the opening 45 is of a structure permitting its close contact with a mounting member 23 through a suitable packing so that waste water may not leak to the exterior even when the interior of the connector is filled with the waste water. Such a seal is well known to those skilled in the art.

Figure 11:
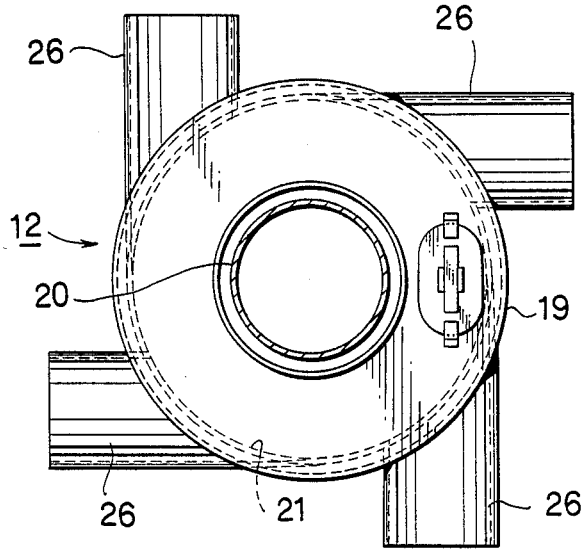
FIG. 11 is a plan view showing still another example of a connector.

Referring now to FIG. 11, there is shown still another modification, in which four inlet pipes 26 are attached to a single connector 12. Each inlet pipe 26 is disposed so that its axis is approximately tangent to the inner peripheral surface of the inner member 21. This is the same as previously noted. As long as this relationship of arrangement is maintained, the connector used in the present invention can have any desired number of inlet pipes.

Figure 12:
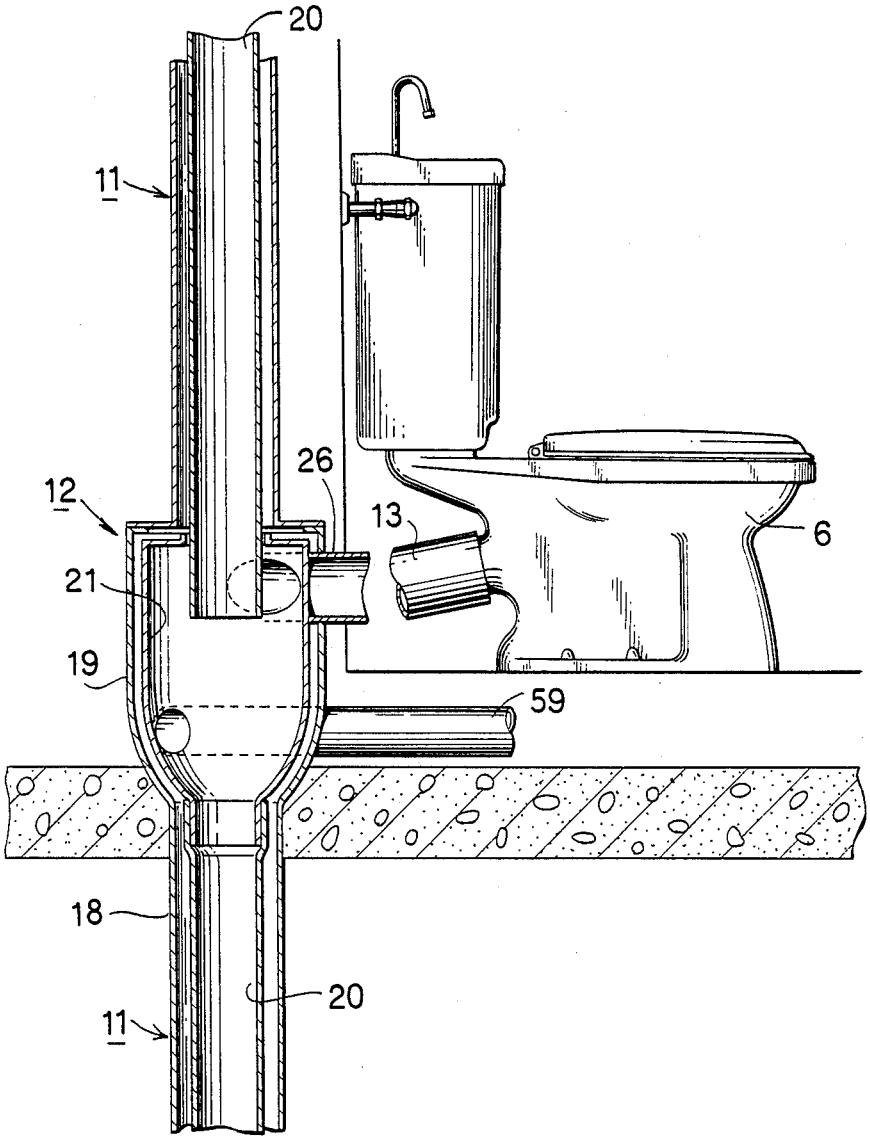
FIG. 12 is a sectional view showing a part of still another drainage system according to the present invention.

Referring now to FIG. 12, there is illustrated a drainage system according to a further embodiment of the present invention, in which there are provided an inlet pipe 26 which communicates through a branch 13 to the drain port of a fixture 6, e.g. a toilet bowl, as well as another inlet pipe. The inlet pipe 59 is for conducting waste water from a fixture (not shown) to the connector 12. One end of the pipe 59 is open to the inside of the inner member 21 of the connector 12 in a position spaced axially from the communication port between the inlet pipe 26 and the inner member 21. The inlet pipe 59 is also disposed so that it has an axis extending approximately tangentially to the cylinder formed by the circumferential wall of the inner member 21. Consequently, the waste water from the inlet pipe 59 forms a circling flow inside the inner member 21.

Figure 13:
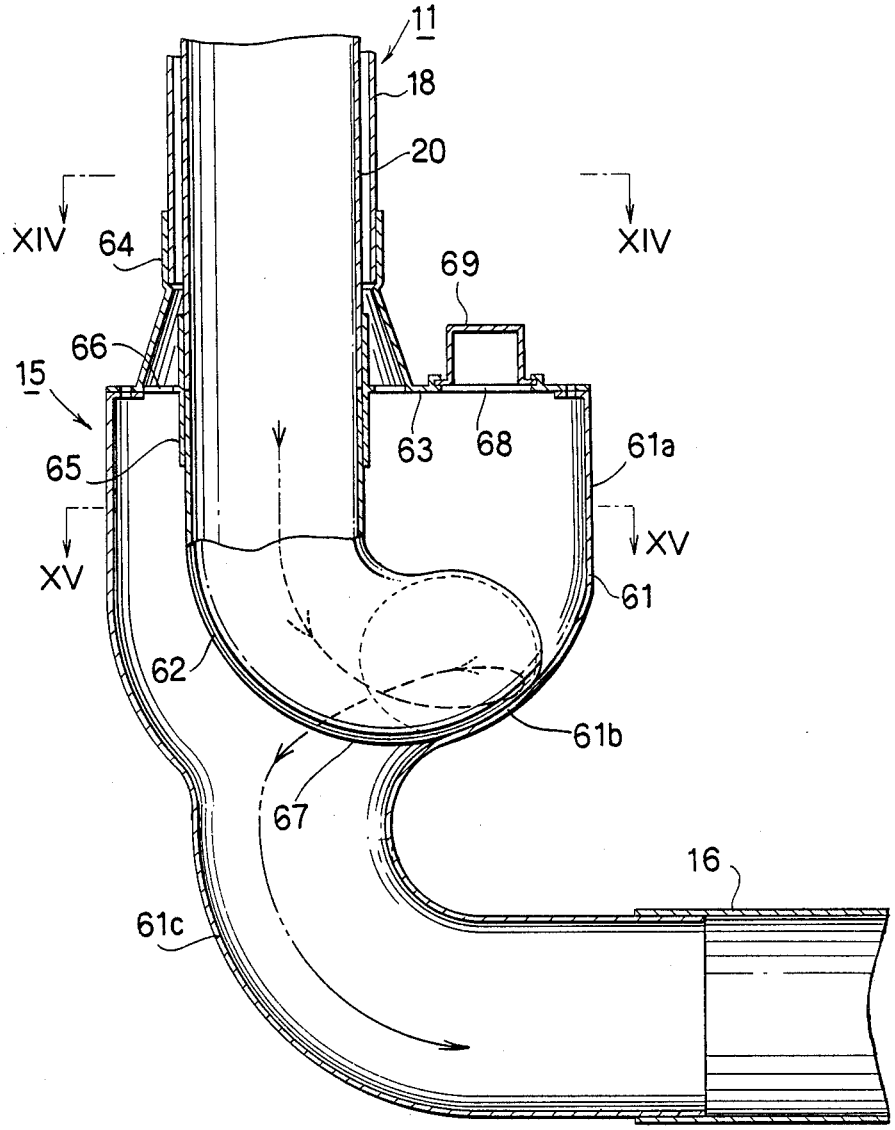
FIG. 13 is a sectional view of a lower end connector used in the drainage system of the invention shown in FIG. 2.
Figure 14:
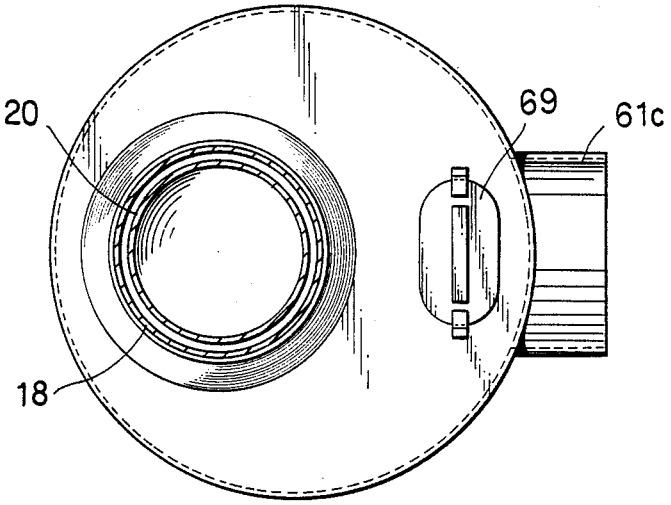
FIG. 14 is a sectional view taken along line XIV—XIV of FIG. 13.
Figure 15:
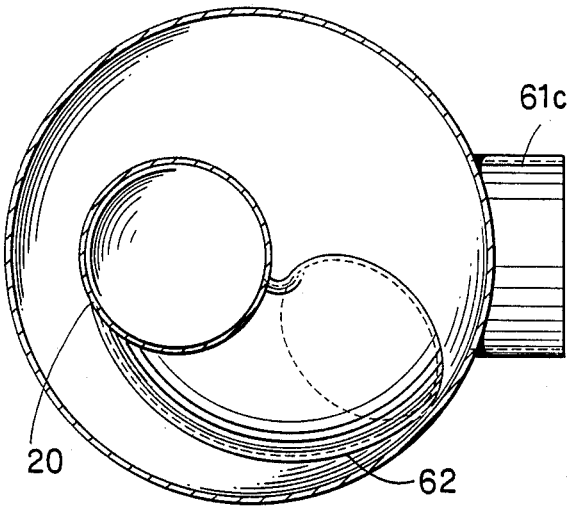
FIG. 15 is a sectional view taken along line XV—XV of FIG. 13.

FIGS. 13, 14 and 15 illustrate the lower end connector 15 provided between the stack 11 and the pipe 16, already shown in FIG. 2. The lower end connector 15 is for effectively preventing the turbulence of flow attributable to a high flowing velocity of waste water and the occurrence of noise in the case where the stack 11 is extremely long, that is, where there is an extremely large head when the waste water which has entered the upper end portion of the stack 11 flows down to the lower end. Therefore, where the stack 11 is not so long, there may be used a conventional bend in place of the lower end connector 15, because the noise is suppressed to a low level under the circling action exerted on the waste water by the connector 12.

In FIGS. 13 to 15, the numeral 61 denotes a generally cylindrical body and numeral 62 denotes a guide cylinder disposed within the outer member. The body 61 has an end plate 63 at the upper end thereof, and one end of the outer member 18 of the stack 11 is connected to a cylindrical connecting member 64 rising from the end plate 63. Further, the end plate 63 has a cylindrical connecting member 65 disposed concentrically inside the connecting member 64. The connecting member 65 connects the inner member 20 of the stack 11 and the inner member 62 of the connector 15 with each other. Numeral 66 denotes a hole as vent means formed in the end plate 63 inside the two connecting members 64 and 65.

The body 61 of the connector 15 comprises a cylindrical upper portion 61*a*, a curved portion 61*b* extending downward from the lower end of the upper portion 61*a* while gradually becoming smaller in diameter, and a bend portion 61*c* which is bent at a predetermined curvature from the lower end of the curved portion 61*b*. To the fore end of the bend portion 61*c* is connected one end of the pipe 16. Preferably, the stack 11 and the bend portion 61*c* are aligned with each other, but the axis of the upper portion 61*a* is positioned somewhat away from the said common axis.

The guide cylinder 62 of the connector 15 has a lower portion with an initial spiral bend obtained by cutting the part from a spirally bent pipe. This spiral portion acts to impart a circling force to the waste water while the waste water flows down through the guide cylinder 62. Preferably, in order to maintain the circling flow of the waste water leaving the spiral portion, the curved portion 61*b* has an inner surface which continues along a line 67 of the spiral initiated by the spiral portion of guide cylinder 62. The reason why the axis of the upper end portion of the guide cylinder 62 is offset with respect to the axis of the upper portion 61*a* of the body 61 is that a space suitable for smooth circling of waste water is to be formed by both the spiral portion and a portion of the wall surface of the body 61. According to experiments, a desirable circling flow is formed when the pitch angle of the spiral portion is about 45 degrees or less (assuming that the angle orthogonal to the axis is zero degree). However, a preferred pitch angle differs according to conditions such as the size of the body 61 and that of the guide cylinder 62, the amount of offset of the inner member, and the flowing velocity of waste water into the inner member. As to an optimum pitch angle under given conditions, it will be possible to find out such angle easily through a simple experiment. Numeral 68 denotes a hole formed in the end plate 63 for maintenance and inspection and numeral 69 denotes a cover which normally closes the said hole.

As previously noted, the waste water which has flowed down through the inner member 20 of the stack 11 flows into the guide cylinder 62 of the lower end connector 15 at a certain given speed, and while passing through the spiral portion of the guide cylinder 62, it is given a circling force about the axis of the body 61. Consequently, in the interior space of the body 61 the waste water flows down gradually while circling in a sticked state to the circumferential wall of the body. This flowing form is also maintained during passing through the bend portion 61*c*. Thus, it is possible to avoid "jumping" and noise which are apt to occur when the waste water flows down straight through the bend portion. By the "jumping phenomenon" is meant that the waste water falling nearly vertically from above through the central portion of the pipe collides vigorously with the layer of waste water which is flowing while changing gradually from the vertical to the horizontal direction along the wall surface positioned outside the curve of the bend portion, and as a result it jumps in the vicinity of the inlet of the horizontal portion of the pipe. The jumping phenomenon not only makes the flowing form of waste water unstable but also plugs the horizontal portion of the pipe temporarily with the waste water, thus causing a large variation in the intra-pipe pressure. Therefore, it should be avoided In the lower end connector 15 constructed according to the teaching of the present invention, such undesirable jumping phenomenon can be surely avoided. Even in the event of occurrence of a pressure variation within the lower end connector 15 or on the upstream side and/or the downstream side thereof, such pressure variation is eliminated immediately by the flow of air between the interior of the body 61 and the outer-inner member passage of the stack 11.

Figure 16:
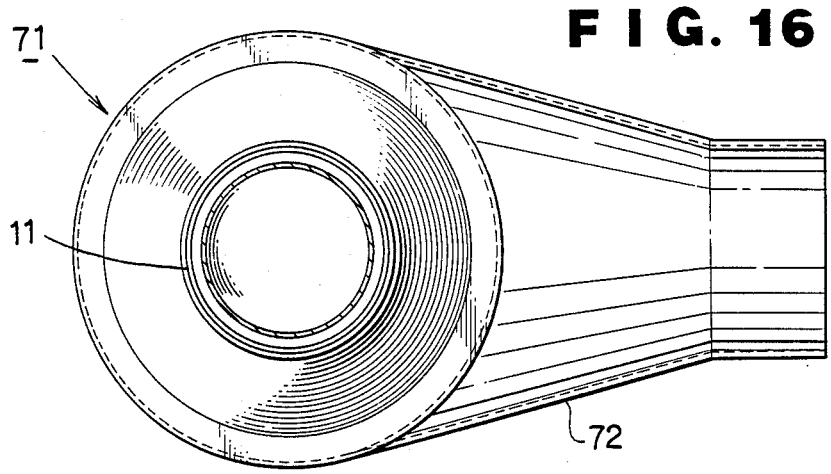
FIG. 16 is a plan view of another example of a lower end connector employable in the drainage system of the invention.
Figure 17:
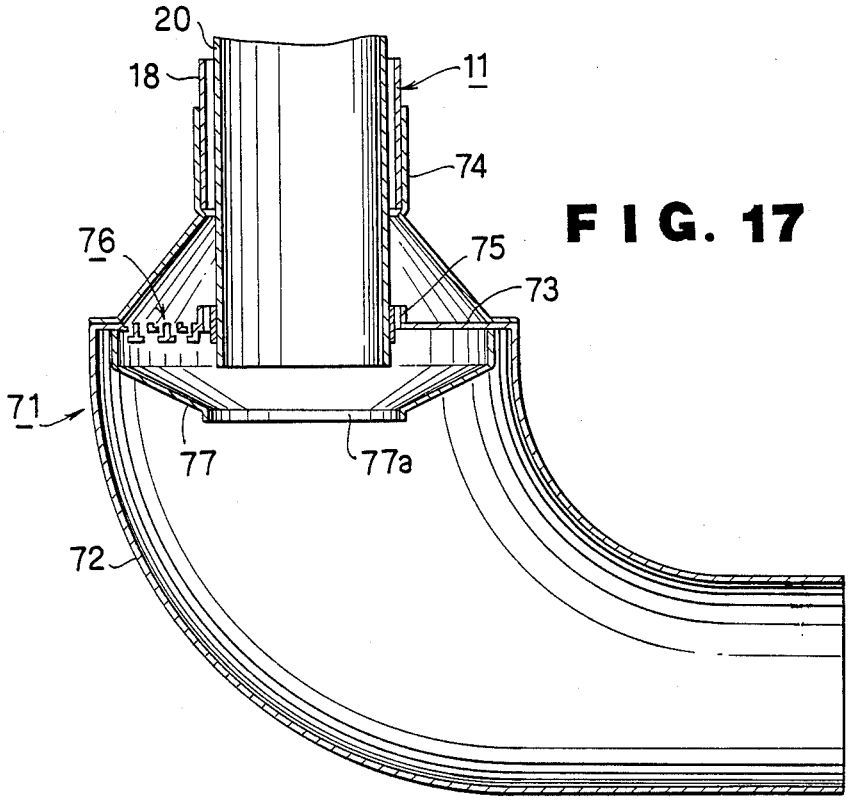
FIG. 17 is a sectional view thereof.

FIGS. 16 and 17 illustrate another form of a lower end connector 71 according to the present invention, having a simpler structure and particularly suitable for the case where the flowing velocity of the waste water at the lower end of the stack is not so high. The lower end connector 71 has a body 72 which is bent nearly perpendicularly at a desired radius of curvature, and an end plate 73 which is fixed to the upper end of the body 72. A connecting member 74 to the upper end of which is connected the outer member 18 of the stack 11, and a connecting member 75 fitted on the inner member 20 through a packing, are attached to the end plate 73. Numeral 76 denotes a vent means provided in the end plate 73. The vent means 76 may be of the same form as the vent means 43 used in the example shown in FIG. 8. Through this vent means there is permitted the flow of air from the interior of the body 72 and between the outer member 18 and inner member 20 of the stack 11. Further, a baffle 77 is fixed to the lower surface of the end plate 73. Like the baffle 49 used in the example of FIG. 7, the baffle 77 is in the form of a ring centrally provided with a circular hole 77*a* which is about the same size as the central hole of the inner member 20. It is inclined so that its distance from the lower surface of the end plate 73 becomes larger and larger from its peripheral edge portion in contact with the end plate 73 toward the edge of the central hole 77*a*. Consequently, the edge of the central hole reaches a position distant from the fore end of the inner member 20, whereby there is formed a cylindrical air passage between the two.

According to the present invention, which should be readily understood from the above description, each stack segment and each connector provided between adjacent stack segments for connecting a branch pipe to the stack have two independent passages which are a drainage passage and a vent passage for eliminating pressure variations in the drainage passage, and yet they are each treated as a single component and can be used constitute a desired drainage system. In other words, as compared with conventional like systems, it is not necessary for the drainage system of the present invention to provide a special pipe for the passing of air, and in this point there is attained a remarkable simplification of the piping structure. As other advantages of the present invention, the connectors which connect branch pipes to the stack have the function of suppressing the noise from waste water to a remarkably low level, and the intra-pipe pressure can be maintained at a constant value almost equal to the atmospheric pressure throughout the system.

In the stack and the connectors both of a double structure comprising an outer member and an inner member disposed inside the outer member concentrically, since the inner member which forms inside a waste water passage is surrounded by an air layer present inside the outer member, it is not necessary to use a heat retaining material that is usually employed for preventing condensation. In such double structure of the stack and connectors, moreover, the outer and the inner member reinforce each other with the result that a remarkably high strength is attained as compared with the pipe of a single structure. Therefore, the required piping strength is obtained even in the use of an inner member of lower strength.

Although the foregoing description has been made in some detail by way of illustration for purpose of clarity and understanding, it will be obvious that many changes and modifications may be practiced within the scope of the appended claims.

What is claimed is:

1. A drainage system including:

a stack which comprises an upper end and a lower end and a plurality of segments, including a top segment, aligned approximately vertically through the floor of each story of a multi-story building, the upper end of the top stack segment being open to the atmosphere;

a plurality of connectors each disposed between adjacent said segments;

each of said plurality of branch pipes connected to one or more fixtures which discharge waste water, each of said plurality of branch pipes being further connected at one end thereof to the stack through one of said plurality of connectors to conduct said waste water from said fixtures to the interior of said stack; and a lower end connector for connecting the lower end of said stack to a horizontal pipe, characterized in that each of said plurality of stack segments is provided with a cylindrical outer member and a cylindrical inner member which is inserted into said outer member coaxially to form an axially extending space annular in cross section between the outer surface of said inner member and the inner surface of said outer member, the inside space of said inner member serving as a passage for said waste water or a drainage passage and said space annular in cross section formed between said inner and said outer member serving as a passage for air or a vent passage, and that each of said plurality of connectors is provided with a generally cylindrical outer member connected to said adjacent stack segments, an upper stack segment of said adjacent stack segments being positioned just above each of said plurality of connectors and a lower stack segment of said adjacent stack segments being positioned just below each of said plurality of connectors, each of said plurality of said connectors being provided with a generally cylindrical inner member inserted into said outer member coaxially, with a space annular in cross section being formed between said outer member and said inner member of each of said plurality of connectors, which space serve as a vent passage for communication between a vent passage of the upper stack segment and that of the lower stack segment, the space formed inside said connector inner member serving as a drainage passage for communication between said drainage passage of said upper stack segment and that of said lower stack segment, each of said plurality of connectors being further provided with at least one inlet pipe which is disposed so as to extend through said connector outer member in a direction approximately coincident with a tangent to a circle formed by the inner peripheral surface of said connector inner member and which is connected at one end thereof to a corresponding branch pipe and is open at the opposite end thereof to said inner peripheral surface of said connector inner member.

2. A drainage system according to claim 1, wherein the inner member of each said stack segment is fixed to the outer member of the same segment through at least one spacer.

3. A drainage system according to claim 1, wherein the inner member of each said stack segment has at least one communication port which permits the flow of air between said drainage passage formed inside said inner member and said vent passage formed outside said inner member.

4. A drainage system according to claim 1, wherein the inner member of each said connector has a portion having a diameter larger than that of the lower end portion of the inner member of the stack segment positioned just thereabove, and one end of said inlet pipe is open to the inner peripheral surface of said larger diameter portion.

5. A drainage system according to claim 4, wherein each of said plurality of connectors is further provided with an end plate between the upper edge of said larger diameter portion and the lower end portion of the inner member of the upper stack segment, said end plate having vent means which permits the flow of air between the vent passage of said stack segment and the inside of the inner member of the connector.

6. A drainage system according to claim 5, wherein said vent means is constituted by a vent member having a plurality of slits and attached to said end plate.

7. A drainage system according to claim 5, wherein said vent means is constituted by a filter element attached to said end plate.

8. A drainage system according to claim 5, wherein the outer member of each of said plurality of connectors has a portion which is in opposed, nearly parallel relation to said end plate, said portion and a corresponding portion of said end plate being each formed with an opening for inspection or maintenance.

9. A drainage system according to claim 1, wherein a plurality of inlet pipes are attached to each said connector so as to be positioned on a plane approximately perpendicular to the axis of the connector.

10. A drainage system according to claim 1, wherein said plurality of connectors are disposed in axially spaced positions.

11. A drainage system including:

a stack which comprises a lower end and a plurality of segments aligned approximately vertically through the floor of each story of a multi-story building;

a plurality of connectors each disposed between adjacent said segments;

a plurality of branch pipes each connected to one or more fixtures which discharge waste water, each of said plurality of branch pipes being further connected at one end thereof to the stack through one of said plurality of connectors to conduct said waste water from said one or more fixtures to the interior of the stack; and a lower end connector for connecting the lower end of the stack to a horizontal pipe, characterized in that each of said plurality of stack segments is provided with a cylindrical outer member and a cylindrical inner member which is inserted into said outer member coaxially to form an axially extending space annular in cross section between the outer peripheral surface of said inner member and the inner peripheral surface of said outer member, the inside space of said inner member serving as a passage for said waste water or a drainage passage and said space annular in cross section formed between said inner and said outer members serving as a passage for air or a vent passage, that each of said plurality of connectors is provided with a generally cylindrical outer member connected to said adjacent stack segments, an upper stack segment of said adjacent stack segments being positioned just above each of said plurality of connectors and a lower stack segment of said adjacent stack segments being positioned just below each of said plurality of said connectors, each of said plurality of connectors being provided with a generally cylindrical inner member inserted into said outer member coaxially, with a space annular in cross section being formed between said outer member and said inner member of each of said plurality of connectors, which space serves as a vent passage for communication between the vent passage of the upper stack segment and that of the lower stack segment, the space formed inside said connector inner member serving as a drainage passage for communication between said drainage passage of said upper stack segment and that of said lower stack segment, each of said plurality of connector being further provided with at least one inlet pipe which disposed so as to extend through said connector outer member in a direction approximately coincident with a tangent to a circle formed by an inner peripheral surface of said connector inner member and which is connected at one end thereof to a corresponding branch pipe and is open at the opposite end thereof to the inner peripheral surface of said connector inner member; and that said lower end connector having a body and an end plate attached to an upper end of said body, said body having an upper portion of a diameter larger than that of the stack segment positioned just thereabove and a bend portion extending curvedly from a lower end of said upper portion and having a generally horizontal fore end connected to a sewer pipe, with a cylindrical connecting member being secured to the upper surface of said end plate for connecting thereto the lower end of said upper stack segment, a lower end of the inner member of said upper stack segment being open to the interior of said body through said end plate, and said end plate having vent means for communication between the interior of said body and said vent passage of said upper stack segment.

12. A drainage system according to claim 11, wherein a guide cylinder is provided in the interior of said body, said guide cylinder being connected at one end thereof to the lower end of said upper stack segment and having a lower end portion having a spiral shape obtained by cutting off a part of a spiral, whereby waste water which has entered said guide cylinder from said inner member is allowed to flow downward while circling along the inner peripheral surface of said body.

13. A drainage system according to claim 12, wherein said body is provided at a portion of its inner circumferential wall with a guide surface extending along an extension line of an outside wall of the fore end portion of said guide cylinder.

14. A drainage system according to claim 12, wherein said spiral portion of said guide cylinder has a pitch angle of about 45 degrees or less.

15. A drainage system according to any of claims 11 to 14, wherein said end plate of said lower end connector is formed with an opening for inspection and maintenance normally closed with a cover.

16. A drainage system according to claim 11, wherein said lower end connector is further provided with a baffle positioned under said end plate, said baffle having a portion positioned under said vent means of said end plate.

* * * * *